US010207907B1

(12) United States Patent
Hamlik et al.

(10) Patent No.: US 10,207,907 B1
(45) Date of Patent: Feb. 19, 2019

(54) HIGH VISIBILITY LOAD CLAMP WITH ASYMMETRICAL GUSSETS

(71) Applicant: Rightline Equipment, Inc., Rainier, OR (US)

(72) Inventors: Jim D. Hamlik, Vancouver, WA (US); Joel D. Hamlik, Vancouver, WA (US)

(73) Assignee: Rightline Equipment, Inc., Rainer, OR (US)

( * ) Notice: Subject to any disclaimer, the term of this patent is extended or adjusted under 35 U.S.C. 154(b) by 0 days.

(21) Appl. No.: 15/706,380

(22) Filed: Sep. 15, 2017

Related U.S. Application Data

(60) Provisional application No. 62/394,984, filed on Sep. 15, 2016.

(51) Int. Cl.
*B66F 9/22* (2006.01)
*B66F 9/18* (2006.01)

(52) U.S. Cl.
CPC ..... *B66F 9/183* (2013.01); *B66F 9/22* (2013.01)

(58) Field of Classification Search
CPC ..... B66F 9/183; B66F 9/22
USPC ..... 414/621, 632
See application file for complete search history.

(56) References Cited

U.S. PATENT DOCUMENTS 2,782,065 A * 2/1957 Lord ..... B66F 9/183 294/119.1
4,090,628 A * 5/1978 Sinclair ..... B66F 9/183 294/104
4,185,944 A * 1/1980 Seaberg ..... B66F 9/183 414/621
4,279,564 A * 7/1981 Weinert ..... B66F 9/183 414/621
4,556,359 A * 12/1985 Sinclair ..... B66F 9/183 294/119.1
5,055,091 A * 10/1991 Morris, Jr. ..... B66F 9/183 294/119.1
5,336,039 A * 8/1994 House ..... B66F 9/143 294/119.1
7,412,919 B2 * 8/2008 Chase ..... B66F 9/22 414/621
9,630,821 B2 * 4/2017 Chase ..... B66F 9/183
2003/0233184 A1 * 12/2003 Roncari ..... B66F 9/183 701/50
2008/0063503 A1 * 3/2008 Garrett ..... A01D 87/122 414/729
2017/0190551 A1 * 7/2017 Chase ..... B66F 9/183

* cited by examiner

*Primary Examiner* — Kaitlin S Joerger

(74) *Attorney, Agent, or Firm* — Rylander & Associates, PC; Philip R.M. Hunt

(57) ABSTRACT

An asymmetrical gusseted clamp assembly configured to be coupled to a lift truck and comprising a frame, two clamp jaws and two actuators. The clamp jaws each have gussets of different size to allow the two actuators to be separated vertically by a central gap, which is defined on the sides by two frame vertical beams. The central gap is of significant width so that the operator of the lift truck has a useable widow through which to view. As the configuration of the asymmetrical gusseted clamp assembly changes from open to closed, at no time is a majority of the view through the central gap obscured by the clamp jaws.

14 Claims, 5 Drawing Sheets

HIGH VISIBILITY LOAD CLAMP WITH ASYMMETRICAL GUSSETS

CROSS-REFERENCE TO RELATED APPLICATION

This application claims the benefit of U.S. Provisional Application No. 62/394,984, filed 15 Sep. 2016, incorporated herein by reference.

FIELD OF THE INVENTION

The present invention relates to cargo handling equipment. More particularly, the present invention relates to load clamps for use primarily with lift trucks.

BACKGROUND

Material handling vehicles such as lift trucks are used to pick up and deliver loads between stations. A typical lift truck 10 has a mast 12, which supports a load-lifting carriage 14 that can be raised along the mast 12 (see FIG. 1). The carriage 14 typically has one or more carriage bars 16 to which a fork frame 18 is mounted. The carriage bars 16 are coupled to the mast in a way that allows the lift truck 10 to move the carriage bars 16 up and down, but not laterally relative to the truck. The fork frame 18 carries a pair of forks 20. An operator of the lift truck 10 maneuvers the forks 20 beneath a load prior to lifting it.

Instead of forks 20, a lift truck 10 may have a load clamp assembly 22 coupled to its mast 12 (See FIG. 2). The load clamp assembly 22 typically comprises a frame 40, one or more actuators 36 and two clamp arms 34. The actuators 36 are configured to move the clamp arms 34 toward or away from each other. In use, the operator of the lift truck 10 approaches a load to be carried, such as a stack of cartons or a large appliance, such as a refrigerator. As the lift truck 10 approaches the load, the operator uses controls to open the gap between the clamp arms 34 wider than the load and may adjust the height of the clamp arms 34 so they will engage the load in a suitable location. The operator then maneuvers the lift truck 10 to straddle the load between the clamp arms 34. When the clamp arms 34 are positioned suitably around the load, the operator uses controls to bring the clamp arms 34 together, grasping the load. The operator then uses other controls to raise the load clamp assembly 22, raising the load off the floor, the load held between the clamp arms 34 by friction. The operator then drives the load to a desired location.

Load clamps, also known as carton clamps, are well known, but existing designs make it difficult for the operator of the lift truck 10 to see through the frame 40 of the load clamp assembly 22 when it has been raised to a position on the mast 12 right in front of the operator's line of sight (e.g., see FIG. 2). This is inconvenient and can waste time. If the best place to grasp a load requires putting the load clamp assembly 22 at a height in the operator's line of sight, the operator can have difficulty approaching the load. The operator may have to lower the load clamp assembly 22, approach the load, and then raise the load clamp assembly 22 before clamping on to the load. Alternatively, the operator can lean out and look around one side of the load clamp assembly 22 and then lean out the other way and look around the other side of the load clamp assembly 22 when approaching the load. However, this is only effective if the load is somewhat narrow. Most load clamp assemblies 22 can spread the clamp arms 34 farther apart than the operator can lean out. This technique can also be tiring for the operator. Once the load is grasped and lifted, the operator can drive the lift truck in reverse to the desired destination with a clear view looking over their shoulder or in a rear view mirror. Most lift truck operators are well skilled in driving in reverse.

BRIEF DESCRIPTION OF THE DRAWINGS

The present invention will be described by way of exemplary embodiments, illustrated in the accompanying drawings in which like references denote similar elements, and in which.

DETAILED DESCRIPTION

Before beginning a detailed description of the subject invention, mention of the following is in order. When appropriate, like reference materials and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Use of directional terms such as "upper," "lower," "above," "below", "in front of," "behind," etc. are intended to describe the positions and/or orientations of various components of the invention relative to one another as shown in the various Figures and are not intended to impose limitations on any position and/or orientation of any embodiment of the invention relative to any reference point external to the reference. Herein, "left" and "right" are from the perspective of an operator of a lift truck when the operator is facing the fork frame. Herein, "lateral" refers to directions to the left or the right and "longitudinal" refers to a direction perpendicular to the lateral direction and to a plane defined by the fork frame.

EXEMPLARY EMBODIMENT

Figure 3:
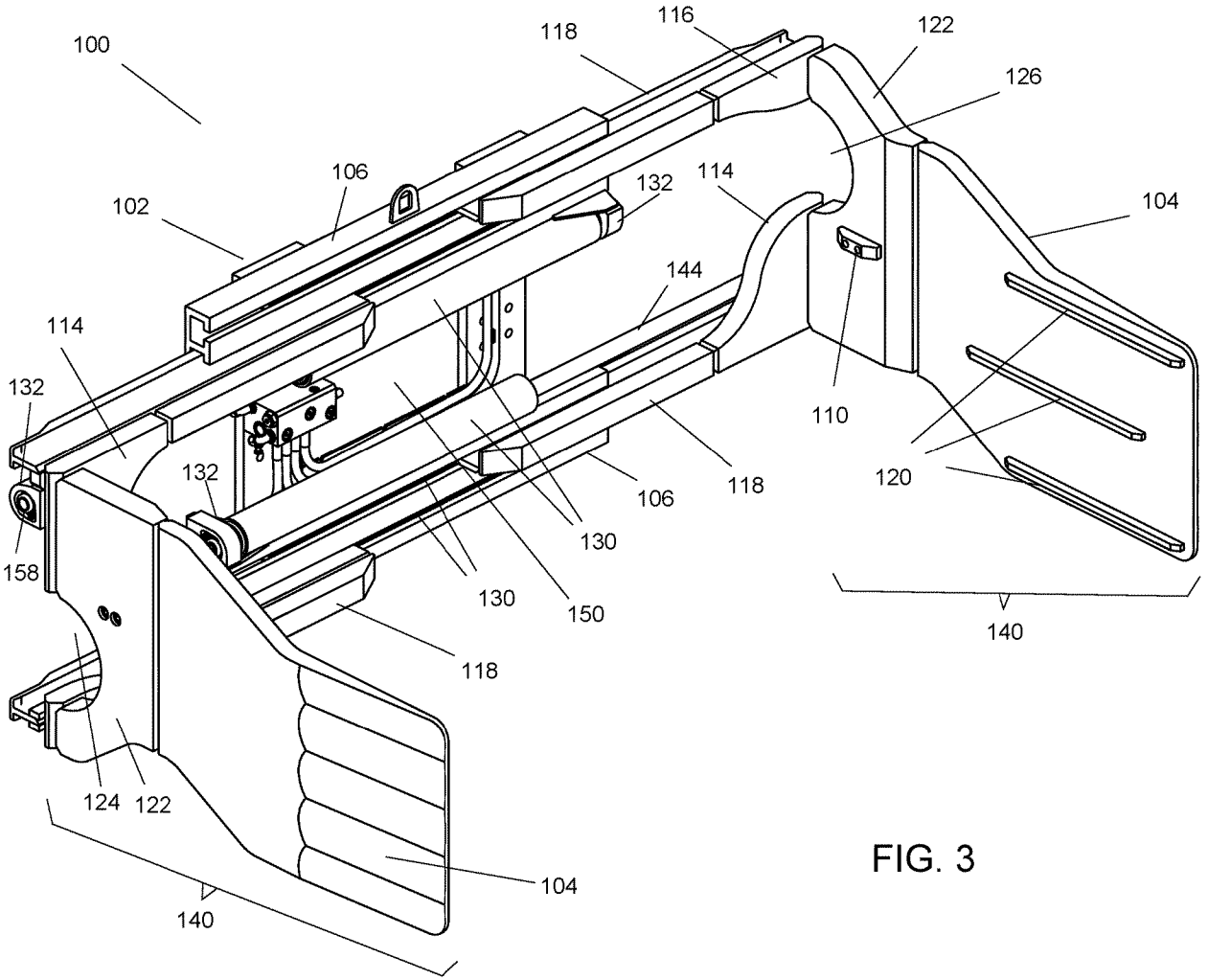
FIG. 3 is an isometric front left view of an exemplary embodiment of an asymmetrical gusseted clamp assembly in an open configuration.
Figure 4:
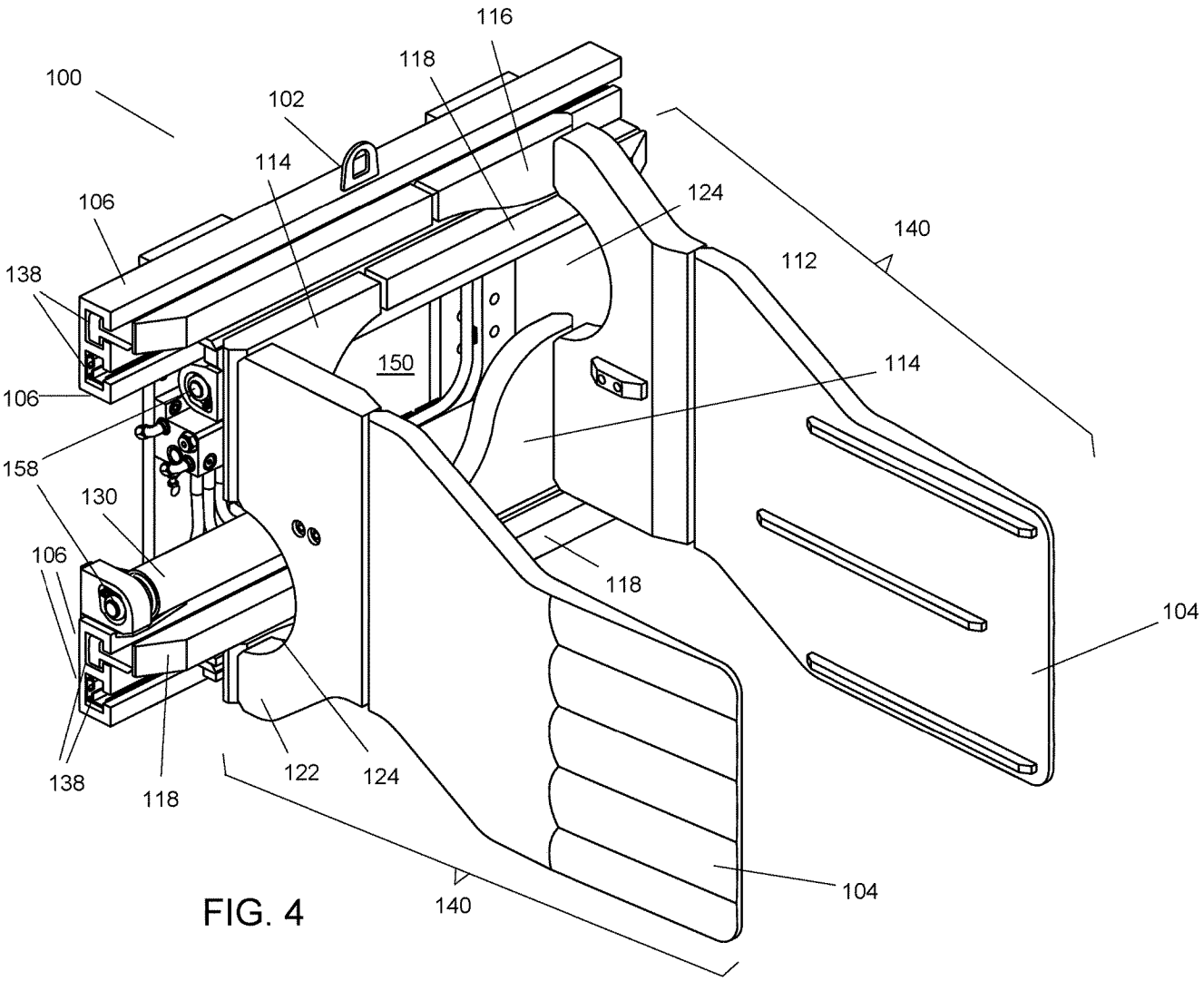
FIG. 4 is an isometric front left view of the exemplary embodiment of the asymmetrical gusseted clamp assembly in a closed configuration.
Figure 5:
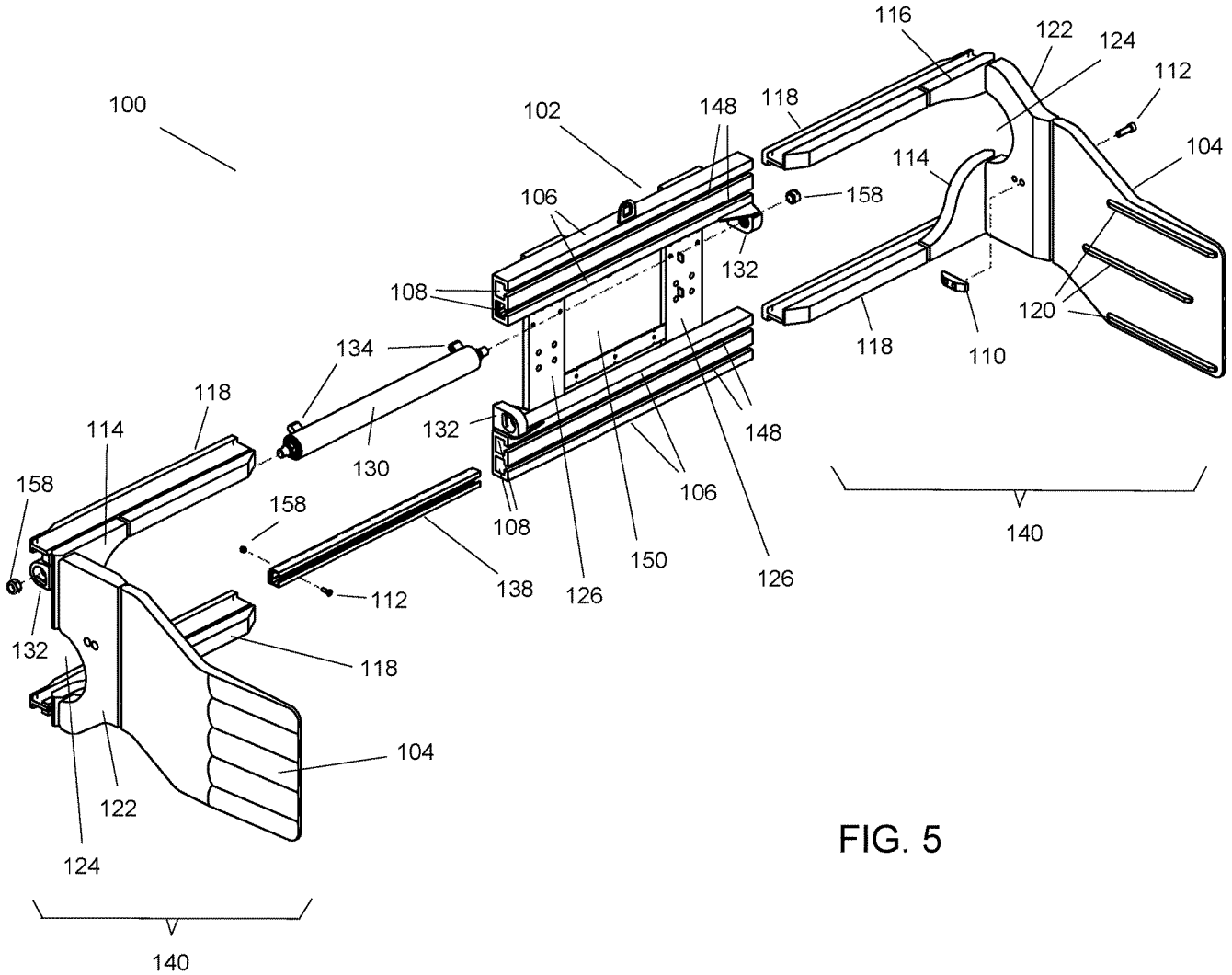
FIG. 5 is an exploded isometric front left view of the exemplary embodiment of the asymmetrical gusseted clamp assembly.

FIGS. 3-5 show an exemplary embodiment of an asymmetrical gusseted clamp assembly 100. The asymmetrical gusseted clamp assembly 100 comprises a frame 102, two clamp jaws 140 and two actuators 130. Each actuator 130 is coupled to the frame 102 and to one of the two clamp jaws 140. The actuators 130 are configured to pull the clamp jaws 140 together or push them apart.

The frame 102 is configured to be coupled to a carriage 14 of a lift truck 10. The frame 102 comprises four guide channels 106 coupled to two frame vertical beams 126, with two guide channels 106 positioned near a top of the frame 102 and two guide channel 106 positioned near a bottom of the frame 102. In the first embodiment asymmetrical gusseted clamp assembly 100, the upper two guide channels 106 share a common channel wall and the lower two guide channels 106 are similar. However, in other embodiments, the guide channels 106 do not necessarily have common walls with adjacent guide channels 106. Two actuator brackets 132 are coupled to the frame 102, one coupled to a bottom of a lower of the upper two guide channels 106, and the other coupled to a top of an upper of the lower two guide channels 106. The upper actuator bracket 132 is position on the right of the frame 102 and the lower actuator bracket 132 is located on the left of the frame 102, when viewed from the front. The two actuators 130 are separated vertically by a central gap 150, which is defined on the sides by the frame vertical beams 126. The central gap 150 is of significant width so that the operator of the lift truck 10 has a useable widow through which to view. When the asymmetrical gusseted clamp assembly 100 is in a closed configuration (see FIG. 4), with the clamp jaws 140 as close together as the actuators 130 can pull them, the actuator rod 144 fully withdrawn, the central gap 150 is not obscured by the clamp jaws 140. When the asymmetrical gusseted clamp assembly 100 is in a sufficiently open configuration (see FIG. 5), with the clamp jaws 140 as far apart as the actuators 130 can push them, the actuator rod 144 fully extended, the central gap 150 is not obscured by the clamp jaws 140 and there is an unobscured view on the outboard sides of the frame vertical beams 126 as well. Furthermore, as the configuration of the asymmetrical gusseted clamp assembly 100 changes from open to closed, at no time is the view through the central gap 150 obscured by the clamp jaws 140. In other embodiments, one or both clamp jaws 140 may obscure a minor portion of the view through of the central gap 150, but leave a majority of the view unobscured in all configurations from open to closed.

Each of the guide channels 106 has a guide channel cavity 108. The guide channels 106 each have a guide channel slot 148 on the front, opening to the guide channel cavity 108. Each guide channel 106 has a channel bearing 138, positioned inside the guide channel cavity 108 and shaped to conform to thereto, and with its own interior cavity that is similarly shaped, but slightly smaller. The channel bearing 138 is detachably coupled to the guide channel 106. In the exemplary embodiment, the channel bearing 138 is detachably coupled to the guide channel 106 with a removable fastener scheme such as the cap screws 112 and nut 158 shown, but in other embodiments, other fastening schemes may be used. The channel bearings 138 are made of suitable bearing material that provides low friction and is softer than the components it has sliding contact with in order to preferentially wear. Since the channel bearings 138 are removable, they can be easily replaced when worn down.

Each actuator 130 has an actuator rod 144 that is coupled to one of the clamp jaws 140. Each actuator 130 has hydraulic fittings 134 connected to hydraulic control lines for operating the actuator 130. Alternatively, the actuators 130 could be coupled to the clamp jaws 140 and the actuator rods 144 coupled to the frame 102, but the hydraulic control lines would require slack and slack management to be able to follow the actuators 130 as they move relative to the frame 102. In other embodiments, actuators 130 may be powered and controlled by schemes other than hydraulic.

Each clamp jaw 140 comprises a clamp arm 104, a clamp arm bracket 122, two clamp sliding beams 118, a large gusset bracket 114 and a small gusset bracket 116. The clamp arm 104 is coupled to the clamp arm bracket 122. The clamp arm bracket 122 is coupled to the large gusset bracket 114 and small gusset bracket 116. The large gusset bracket 114 is coupled to one of the two clamp sliding beams 118 and the small gusset bracket 116 is coupled to the other clamp sliding beam 118. The large gusset bracket 114 is coupled to an actuator bracket 132, which couples the clamp jaw 140 to the actuator 130.

The clamp arm 104 has one or more contact bars 120 and the clamp arm bracket 122 has one or more contact shoe 110. The contact bars 120 and contact shoe 110 are made of material that provides high friction for grasping loads and is also soft, so it preferentially wears rather than the load.

The two clamp sliding beams 118 of each clamp jaw 140 are configured to slidingly fit into two of the guide channels 106 of the frame 102. More specifically, the clamp sliding beams 118 insert into the channel bearings 138 of the guide channels 106 with a sliding fit. In the exemplary embodiment, the portion of each clamp sliding beam 118 inserted into the guide channel 106 has a "T" cross-section, with the top of the "T" held inside the guide channel 106 and the base of the "T" extending out of the guide channel slot 148. However, in other embodiments, the guide channel 106 and the clamp sliding beam 118 may have other suitable cross-sectional shapes.

Figure 1:
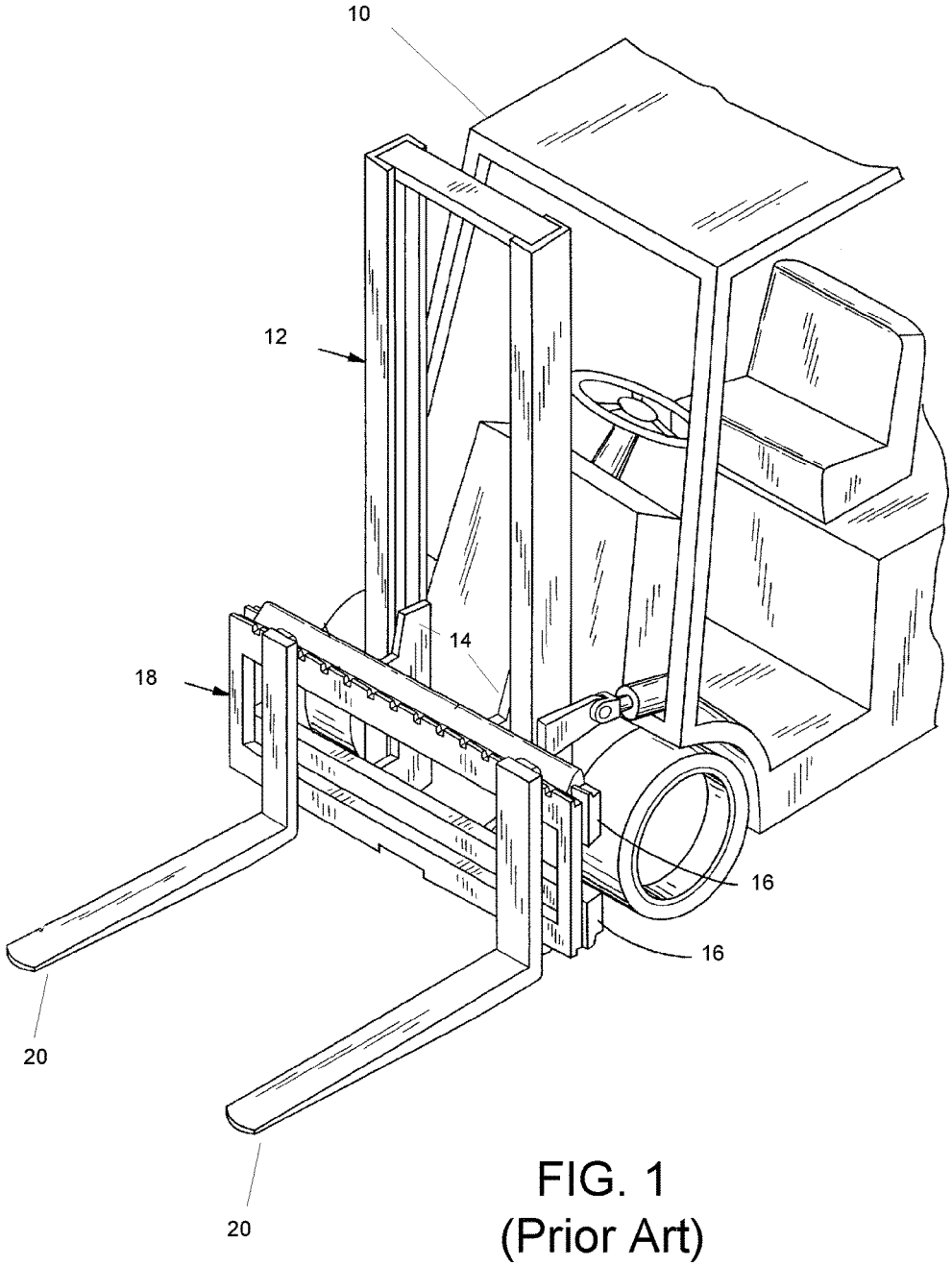
FIG. 1 (Prior Art)
FIG. 1 is an isometric view of a prior art lift truck, illustrating typical components of a lift truck equipped with forks.
Figure 2:
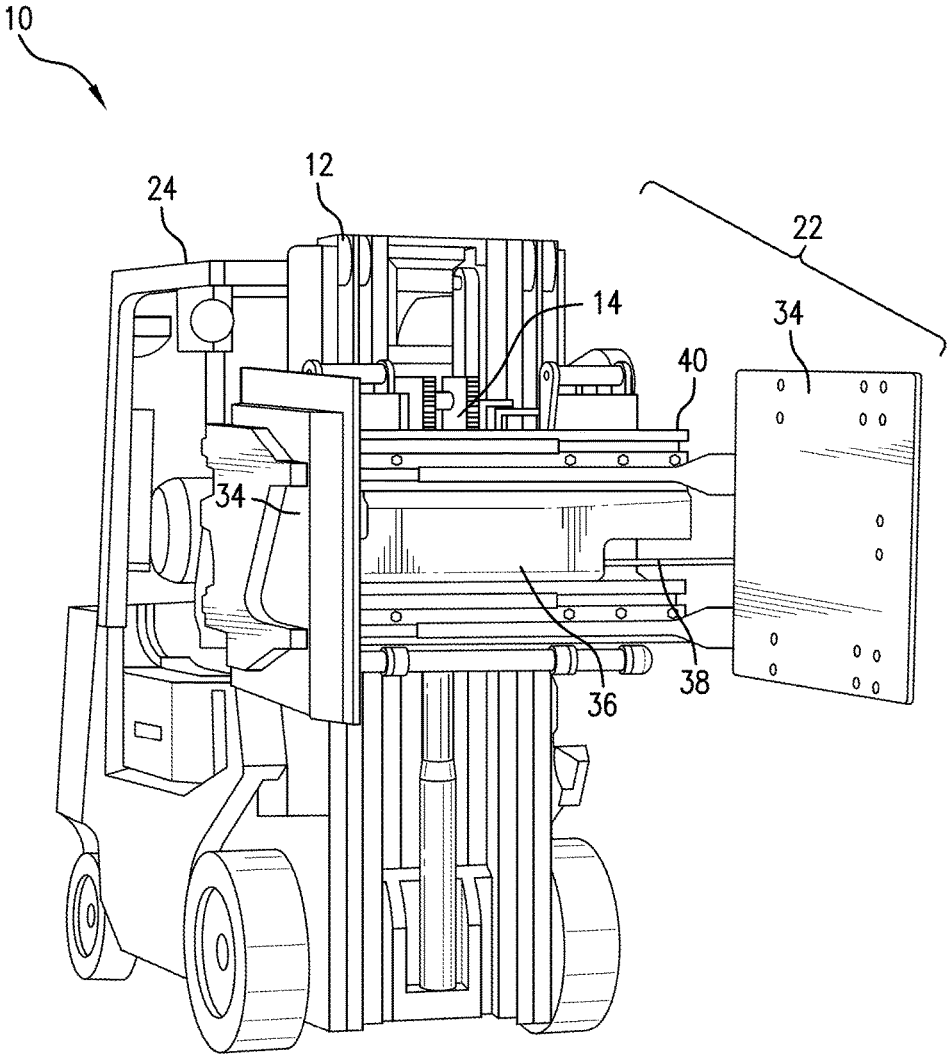
FIG. 2 (Prior Art)
FIG. 2 is an isometric view of a prior art lift truck, illustrating typical components of a lift truck equipped with a load clamp assembly.

The point where the actuator rod 144 couples to the clamp jaw 140, at the actuator bracket 132 on the large gusset bracket 114, is off-center from the center of mass of the clamp jaw 140. Placing the coupling point closer to the center of mass of the clamp jaw 140 would place the actuator 130 closer to the center of the frame 102, completely blocking the central gap 150 or reducing it to an unusable size, as is the case with prior art load clamps (e.g. FIG. 2). However, placing the actuator attachment point off-center produces some problems. For example, looking at the clamp jaw 140 on the right in FIGS. 3-5, the actuator 130 pulling on the clamp jaw 140 will produce a torque around the points where the upper and lower clamp sliding beams 118 contact the respective guide channels 106, clockwise torque for the upper clamp sliding beam 118 and counter-clockwise torque for the lower clamp sliding beam 118. Since the actuator 130 couples on the large gusset bracket 114 close to the lower clamp sliding beam 118, the moment arm is longer for the clockwise torque and it overwhelms the counter-clockwise torque, resulting in a net clockwise torque, causing a clockwise twist to the clamp jaw 140. The twist pulls the clamp sliding beams 118 out of alignment with the guide channels 106. This concentrates where force is applied by the clamp sliding beams 118 in the guide channels 106, increasing wear on the channel bearings 138, increasing friction between the clamp sliding beams 118 and the guide channels 106. A jam may occur if the increased friction cannot be overcome by the lateral force applied by the actuator 130.

The problems created by the off-center coupling point of the actuator 130 to the clamp jaw 140 is mitigated by the large gusset bracket 114. Still looking at the clamp jaw 140 on the right in FIGS. 3-5, the large gusset bracket 114 functions to distribute the force received from the actuator 130 to the clamp arm bracket 122 more toward the vertical center of mass of the clamp jaw 140. This will reduce the amount of net torque on the clamp jaw 140, which means a reduced amount of twist. The large gusset bracket 114 also provides additional torsional stiffness to the clamp jaw 140, which also helps reduce the amount of twist.

In the exemplary embodiment, an interior side of the large gusset bracket 114 (i.e., the side facing the small gusset bracket 116) is in a shape of a symmetrical sigmoid or ogee curve. The sigmoid curve shape provides the most torsional stiffness for a given height or a given mass of the large gusset bracket 114. In other embodiments, the large gusset bracket 114 may have a shape that is non-symmetrical ogee, triangular or other shape.

The clamp arm bracket 122 has a cut-out 124 in a side of the clamp arm bracket 122 that is coupled to the large gusset bracket 114 and small gusset bracket 116. The clamp arm bracket cut-out 124 allows the clamp jaw 140 to slide past the actuator 130 and clamp sliding beams 118 for the other clamp jaw 140 when moving towards the closed configuration (see FIG. 4), while still maintaining maximum contact with the large gusset bracket 114 and small gusset bracket 116 for better transmission of forces from a load or from the actuators 130. In the exemplary embodiment, the clamp arm bracket cut-out 124 is just barely large enough to accommodate passage of the actuator 130 and clamp sliding beam 118 from the other clamp jaw 140, with the clamp arm bracket cut-out 124 extending less than half the distance between the clamp sliding beams 118 of the clamp jaw 140. This configuration will better distribute forces transmitted between the clamp arm bracket 122 and the large gusset bracket 114 and small gusset bracket 116 than if the clamp arm bracket cut-out 124 were larger. However, in other embodiments, the clamp arm bracket cut-out 124 may be larger. In the exemplary embodiment, the clamp arm bracket cut-out 124 has a circular arc shape, which will better distribute forces transmitted between the clamp arm bracket 122 and the large gusset bracket 114 and small gusset bracket 116 than if the clamp arm bracket cut-out 124 were another shape. However, in other embodiments, the clamp arm bracket cut-out 124 may have a different shape.

The large gusset bracket 114 has a portion contacting the clamp arm bracket 122 that extends from the adjacent clamp sliding beam 118 to the clamp arm bracket cut-out 124, and extends at least half a distance between the two clamp sliding beams 118 of the clamp jaw 140. This configuration increases the torsional stiffness the large gusset bracket 114 adds to the clamp jaw 140 more than a large gusset bracket 114 that does not extend as far. This configuration also distributes forces applied by the actuator 130 further towards a point equidistant between the upper and lower clamp sliding beams 118, which reduces the amount of net torque the clamp jaw 140 experiences from forces applied by the actuator 130. However, in other embodiments, the portion of large gusset bracket 114 contacting the clamp arm bracket 122 may extend from the adjacent clamp sliding beam 118 to a point short of the clamp arm bracket cut-out 124 and/or may extend somewhat less than half the distance between the two clamp sliding beams 118.

The large gusset bracket 114 has a width that varies vertically due to the ogee curve of the interior surface of the large gusset bracket 114. In the exemplary embodiment, the ogee curve of the interior surface of the large gusset bracket 114 is configured such that when the asymmetrical gusseted clamp assembly 100 is in a closed configuration, the central gap 150 is not obscured by the large gusset bracket 114. In other embodiments, the large gusset bracket 114 partially obscures a minor part of the view through the central gap 150 in some configurations, but leaves a majority of the view unobscured.

The small gusset bracket 116 is similar to the large gusset bracket 114, with a similar shape, but smaller. The small gusset bracket 116 has a portion contacting the clamp arm bracket 122 that extends from the adjacent clamp sliding beam 118 to the clamp arm bracket cut-out 124. The clamp arm bracket cut-out 124 is closer to the small gusset bracket 116 than to the large gusset bracket 114, so the small gusset bracket 116 cannot be made as large as the large gusset bracket 114. However, in other embodiments, the portion of small gusset bracket 116 contacting the clamp arm bracket 122 may extend from the adjacent clamp sliding beam 118 to a point short of the clamp arm bracket cut-out 124.

The clamp jaw 140 on the left is similar to clamp jaw 140 on the right, but with the large gusset bracket 114 coupled to the upper clamp sliding beam 118 instead of the lower clamp sliding beam 118. In other embodiments, the clamp jaw 140 on the left may have a large gusset bracket 114 coupled to the lower clamp sliding beam 118 and the clamp jaw 140 on the right have a large gusset bracket 114 coupled to the upper clamp sliding beam 118, with other components similarly changing position, mutatis mutandis. For instance, the upper actuator 130 will be coupled to the large gusset bracket 114 on the right clamp jaw 140 and the lower actuator 130 will be coupled to the large gusset bracket 114 on the left clamp jaw 140.

Those skilled in the art will recognize that numerous modifications and changes may be made to the various embodiments without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the first embodiment is essential. Other embodiments are possible, their specific designs depending upon the particular application. As such, the scope of the invention should not be limited by the particular embodiments herein described but should be defined only by the appended claims and equivalents thereof.

What is claimed is:

1. A asymmetrical gusseted clamp assembly comprising:

a frame with two frame vertical beams, a first guide channel and a second guide channel positioned near a top of the frame, a third guide channel and a fourth guide channel positioned near a bottom of the frame;

a first actuator coupled the frame below the first guide channel and second guide channel;

a second actuator coupled to the frame above the third guide channel and the fourth guide channel, a gap between the first actuator and the second actuator;

a first clamp jaw with a first clamp arm coupled to a first clamp arm bracket, the first clamp arm bracket coupled to a first large gusset bracket and a first small gusset bracket, the first large gusset bracket coupled to a first lower sliding beam, the first small gusset bracket coupled to a first upper sliding beam;

wherein the second actuator is coupled to the first large gusset bracket; and wherein the first upper sliding beam slidingly inserted in the first guide channel and the first lower sliding beam slidingly inserted in the third channel guide.

2. The asymmetrical gusseted clamp assembly of claim 1, a central gap between the two frame vertical beams, the first actuator and the second actuator, wherein the first clamp jaw does not obscure a view through the central gap when the asymmetrical gusseted clamp assembly is in an open configuration.

3. The asymmetrical gusseted clamp assembly of claim 2 wherein the first clamp jaw does not obscure the view through the central gap when the asymmetrical gusseted clamp assembly is in a closed configuration.

4. The asymmetrical gusseted clamp assembly of claim 2, wherein the first clamp jaw and a second clamp jaw obscure less than a majority of the view through the central gap when the asymmetrical gusseted clamp assembly is in a closed configuration.

5. The asymmetrical gusseted clamp assembly of claim 1, further comprising:

a second clamp jaw with a second clamp arm coupled to a second clamp arm bracket, the second clamp arm bracket coupled to a second large gusset bracket and a second small gusset bracket, the second small gusset bracket coupled to a second lower sliding beam, the second small gusset bracket coupled to a second upper sliding beam;

wherein the first actuator is coupled to the second large gusset bracket; and wherein the second upper sliding beam slidingly inserted in the second guide channel and the second lower sliding beam slidingly inserted in the fourth guide channel.

6. The asymmetrical gusseted clamp assembly of claim 5, a central gap between the two frame vertical beams, the first actuator and the second actuator, wherein the first clamp jaw and the second clamp jaw do not obscure a view through the central gap when the asymmetrical gusseted clamp assembly is in an open configuration.

7. The asymmetrical gusseted clamp assembly of claim 6, wherein the first clamp jaw and the second clamp jaw do not obscure the view through the central gap when the asymmetrical gusseted clamp assembly is in a closed configuration.

8. The asymmetrical gusseted clamp assembly of claim 6, wherein the first clamp jaw and the second clamp jaw obscure less than a majority of the view through the central gap when the asymmetrical gusseted clamp assembly is in a closed configuration.

9. The asymmetrical gusseted clamp assembly of claim 5, wherein the first clamp arm bracket has a cut-out through which pass the first actuator and the second upper sliding beam when the asymmetrical gusseted clamp assembly is in a closed configuration.

10. The asymmetrical gusseted clamp assembly of claim 9, wherein clamp arm bracket cut-out has a circular arc shape.

11. The asymmetrical gusseted clamp assembly of claim 10, wherein clamp arm bracket cut-out extends less than half a distance between the first lower sliding beam and the first upper sliding beam.

12. The asymmetrical gusseted clamp assembly of claim 9, wherein the first large gusset bracket has a portion contacting the first clamp arm bracket that extends from the first lower sliding beam to the cut-out of the first clamp arm bracket.

13. The asymmetrical gusseted clamp assembly of claim 1, wherein the first large gusset bracket has a portion contacting the first clamp arm bracket that extends from the first lower sliding beam to at least half a distance between the first lower sliding beam and the first upper sliding beam.

14. The asymmetrical gusseted clamp assembly of claim 1, 2, 3, 4, 6, 7, 8, 9, 10, 11, 12, or 13, wherein the first large gusset bracket has an interior side that has an ogee curve shape.

* * * * *